United States Patent [19]

Jewell, Jr. et al.

[11] Patent Number: 4,953,660

[45] Date of Patent: Sep. 4, 1990

[54] MUFFLER WITH TWO PART HOUSING AND FLOW TUBES

[75] Inventors: Raymond S. Jewell, Jr., Jackson; William E. Hill, Ann Arbor, both of Mich.

[73] Assignee: Tennessee Gas Pipeline Company, Lincolnshire, Ill.

[21] Appl. No.: 308,134

[22] Filed: Feb. 9, 1989

[51] Int. Cl.[5] ..... F01N 1/02; F01N 1/08; F01N 7/18

[52] U.S. Cl. ..... 181/282; 181/266; 181/272

[58] Field of Search ..... 181/228, 239, 241, 243, 181/250, 268, 272, 273, 282, 265, 266

[56] References Cited

U.S. PATENT DOCUMENTS

| | | | |
|---|---|---|---|
| 3,080,940 | 3/1963 | Jobson . | |
| 4,109,751 | 8/1978 | Kabele | 181/247 |
| 4,111,279 | 9/1978 | Sterrett | 181/264 |
| 4,119,174 | 10/1978 | Hoffman | 181/231 |
| 4,192,401 | 3/1980 | Deaver et al. | 181/266 |
| 4,381,045 | 4/1983 | Buchwalder | 181/265 |
| 4,456,091 | 6/1984 | Blanchot | 181/243 X |
| 4,735,283 | 4/1988 | Macaluso | 181/265 |
| 4,759,423 | 7/1988 | Harwood et al. | 181/282 |

FOREIGN PATENT DOCUMENTS 312943 7/1929 United Kingdom .

*Primary Examiner*—Benjamin R. Fuller
*Attorney, Agent, or Firm*—Harness, Dickey & Pierce

[57] ABSTRACT

An automotive exhaust gas muffler comprises gas passage tubes supported in curved portions of two press-formed metal housing parts and communicate with recesses formed in the housing parts.

20 Claims, 3 Drawing Sheets

MUFFLER WITH TWO PART HOUSING AND FLOW TUBES

This invention relates to sound attenuating mufflers for use in exhaust gas systems of automobiles and trucks.

It is a purpose of this invention to simplify the manufacture of most production exhaust gas mufflers without sacrifice in sound attenuation performance. The invention accomplishes this purpose by a change in muffler hardware that retains proven methods of operation and sound attenuation, e.g., tri-flow and resonator action used in automotive mufflers for many years, louver flow illustrated in U.S. Pat. No. 4,192,401, issued Mar. 11, 1980, and high performance flow illustrated in U.S. Pat. No. 4,735,283, issued Apr. 5, 1988.

BRIEF SUMMARY OF THE INVENTION

According to the invention, the muffler housing is composed of two parts which are produced by the press-forming of recesses in two flat metal blanks, the recesses in the two parts combining with each other when the parts are secured together to provide a plurality of internal chambers in the housing. During formation of the recesses, the two metal blanks are also press formed to produce curved portions which combine when the two parts are clamped together to form tubular passages that interconnect the internal chambers. Gas flow tube members of the type used in the aforementioned sound attenuation methods are positioned in some or all of these tubular passages and held in place by the two parts. The gas flow tube members, the internal chambers, and the tubular passages are constructed and arranged to attenuate objectionable sound in gas flowing through the muffler in accordance with the tri-flow, louver flow, high performance flow, or other sound attenuation methodology. High performance may be enhanced by flow guiding curvatures press-formed in the ends of the two housing parts.

Other features and advantages will become apparent in the description which follows:

DETAILED DESCRIPTION OF EMBODIMENTS OF THE INVENTION

Figure 1:
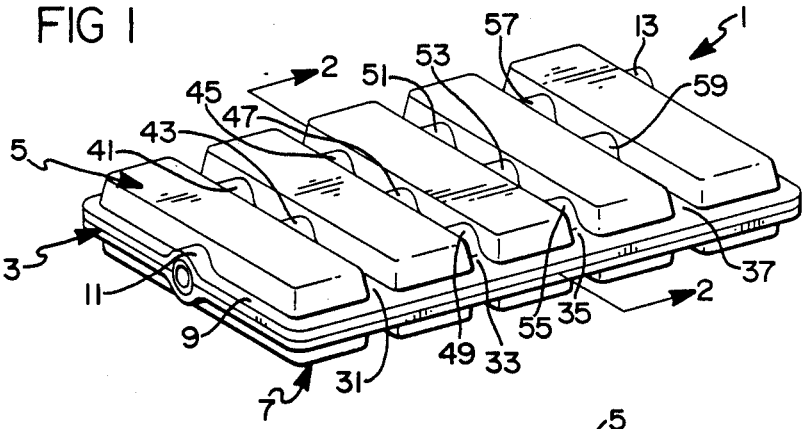
FIG. 1 is a perspective view of one form of muffler embodying the invention in which there is a tri-flow gas pattern through three chambers and two resonator chambers.

An automotive exhaust system muffler 1 has an outer housing or shell 3 comprising upper and lower pan-shaped sections or halves 5 and 7, respectively, which in the embodiment shown are substantially mirror images of each other. The halves are metal stampings, i.e., power press formed from flat strips or sheets of metal, ordinarily low carbon steel or stainless steel. Each half is substantially rectangular in plan view and has an outer circumferential flange 9 or rim around all four sides which is flat except for curved inlet and outlet forming collar portions 11 and 13 at opposite ends. The flat outer flange 9 remains from the original flat metal blank in which the final shape of the half 5 or 7 is formed. This shape includes a plurality of drawn pan-shaped rectangular cups or recesses of rectangular cross section. Five such recesses, identified by reference numbers 15, 17, 19, 21, and 23, are illustrated as having been pressed into the top and the bottom halves 5 and 7. Each has pairs of sidewalls 25 and 27 tapered on the desired draft angle and a flat bottom 29. While the recesses are shown to be of the same size, in the broad aspect of the invention they may be of different sizes and there may be more or less than five of them as seen hereinafter.

The recesses are separated by flat divider sections 31, 33, 35, and 37 which extend transversely across the width of the half 5 and 7. They are coplanar with the flat outer flange 9 and remain flat with it as a part of the original flat metal blank from which the half is formed. Section 31 separates recesses 15 and 17; section 33 separates recesses 17 and 19; section 35 separates recesses 19 and 21; and section 37 separates recesses 21 and 23.

While basically flat, the divider sections 31, 33, 35, and 37 do have curved portions in them connecting adjacent recesses and these may be drawn in the original flat blank at the same time as the recesses 15, 17, 19, 21, and 23 and the curved portions 11 and 13. All the curved portions are preferably semi-cylindrical and of semi-circular cross section so that when the two halves 5 and 7 are placed together, the curved portions will define short longitudinal passages of circular cross section. In the form of muffler shown in FIGS. 1–3, section 31 has two semi-cylindrical portions 41 and 43; section 33 has three semi-cylindrical portions 45, 47, and 49; section 35 has three semi-cylindrical portions 51, 53, and 55; and section 37 has two semi-cylindrical portions 57 and 59. Portions 41, 45, 51, 57, and 13 are aligned on a common axis; portions 11, 43, 47, 53, and 59 are aligned on a common axis; and portions 49 and 55 are aligned on a common axis.

A straight gas flow inlet tube 61 of round cross section is laid in aligned portions 11, 43, 47, and 53. A straight outlet tube 63 of round cross section is laid in aligned portions 45, 51, 57, and 13; a straight return flow tube 65 of round cross section is laid in aligned portions 49 and 55; and a straight tuning tube 67 of round cross section is laid in portion 59.

Figure 2:
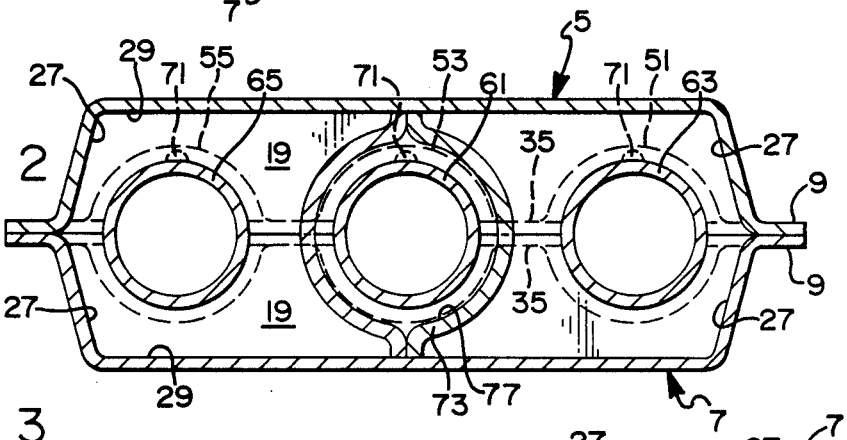
FIG. 2 is a cross section along line 2—2 of FIG. 1.
Figure 3:
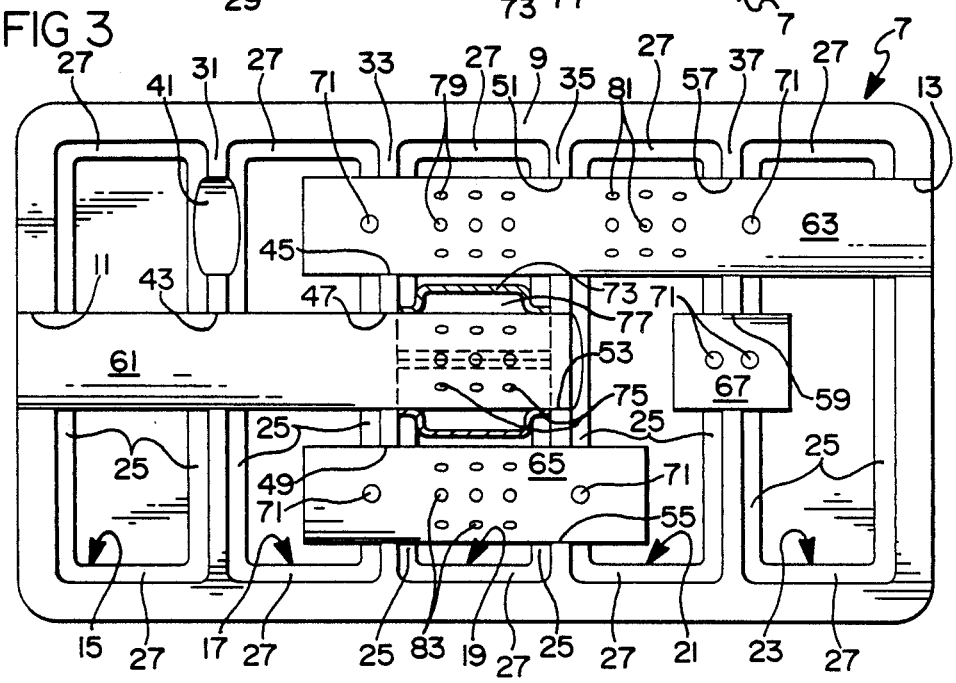
FIG. 3 is a plan view of the bottom housing half with the tubes laid in place, ready for assembly with the symmetrical top housing half.

While the tubes may be welded in place, it is to be noted that by proper sizing of the tubes and of the curved portions, the tubes will be tightly clamped to the various curved portions when the two halves are put together as in FIGS. 1 and 2 and their respective rims 9 welded or otherwise securely fastened together. Mechanical means such as dimples or projections 71 may be formed in the tubes to engage walls 25 and provide positive abutments or stops to hold the tubes in their original longitudinal positions. Tube 61 is illustrated with a pancake or pinch-down shell 73 affixed to that portion of the tube which is in recess 19; and this will engage the walls 25 of recesses 19 to fix the axial position of tube 61.

Inlet tube 61 is shown as having a patch 75 of perforations or louvers through that portion of its wall that is in recesses 19, these therefore opening into the closed chamber 77 inside of shell 73. Outlet tube 63 is shown as having a patch 79 of perforations or louvers through that portion of its wall that is in recesses 19 and another such patch 81 in recesses 21. Return flow tube 65 is shown as having a patch 83 of perforations or louvers through that portion of its wall that is in recesses 19.

When the upper half 5 of the housing 3 is placed on top of the lower half 7 so that the mating rims or flanges 9 engage each other, the various tubes will be clamped in place and the mating recesses 15, 17, 19, 21, and 27 will combine to form gas flow and sound attenuation chambers 15, 17, 19, 21, and 27. The flanges 9 are welded or otherwise securely fastened to each other in a gas tight manner.

In operation, inlet gas passage 61 is suitably connected to an exhaust pipe (not shown) to receive incoming exhaust gas. The gas leaves the open downstream end of tube 61 to enter turn-around chamber 21 where it expands, reverses direction, and flows into the open upstream end of tube 65. Gas flows out of the open downstream end of tube 65 to enter turn-around chamber 17, where it expands, reverses direction, and flows into the open upstream end of outlet tube 63. It flows in tube 63 to its open downstream end which is suitably connected to a tailpipe (not shown) for conducting the gas, ordinarily, to the rear of a vehicle for discharge into the atmosphere.

All tubes extend through chamber 19 which serves as an expansion chamber that permits some cross bleeding from louvers 83 in return tube 65 to louvers 79 in outlet tube 63. This action attenuates medium and high sound frequencies. Spit chamber 77, also located in expansion chamber 19, serves to attenuate high frequency noise, roughness, and "spit" in the exhaust gas.

End chamber 23 has only tube 67 to connect it to gas flowing through the muffler. The cross sectional area and length of this tube can be chosen in relationship to the volume of chamber 23 in accordance with the Helmholtz formula to provide a resonator-tuning tube combination for attenuating a selected low sound frequency.

Similarly end chamber 15 has only mating openings 41 in the upper and lower halves 5 and 7 to connect it to gas in the muffler. Since the length of tubular opening 41 is relatively fixed, its diameter can be tuned to some extent in accordance with Helmholtz theory to the volume of chamber 15 to provide for attenuation of another selected low frequency.

Thus, the muffler 1 contains a full tri-flow sound attenuation system along with two tuning tube resonator chamber combinations and is capable of attenuating substantially the full spectrum of objectionable sound in modern combustion engines.

Figure 4:
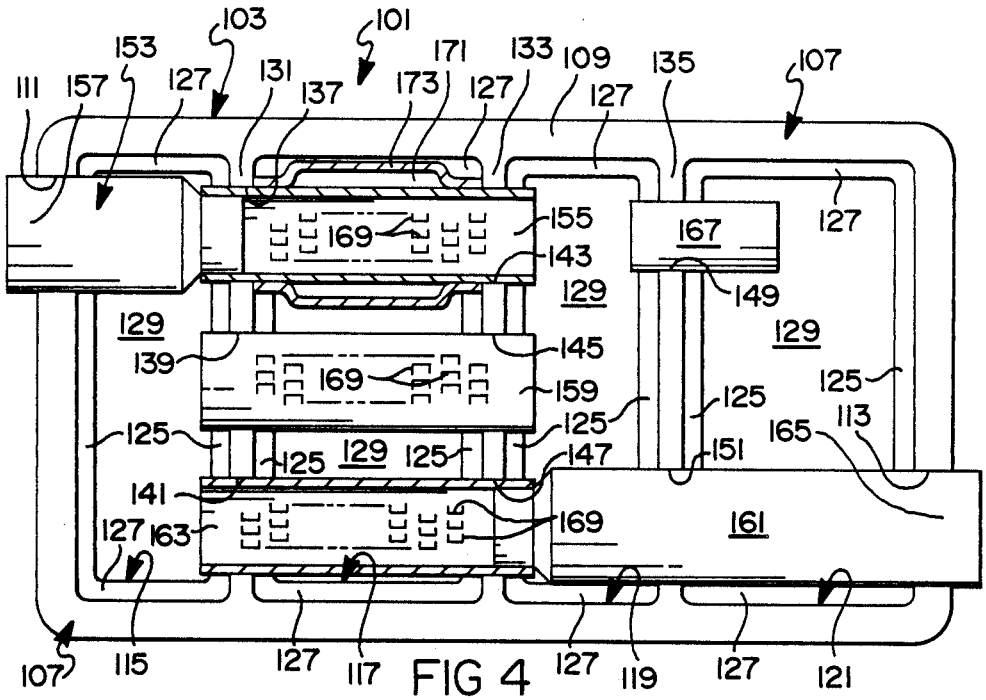
FIG. 4 is a view similar to FIG. 3 but showing a different tri-flow muffler construction having four chambers.

The muffler 101 of FIG. 4 has an outer housing or shell 103 comprising upper and lower pan-shaped halves (like the halves 5 and 7) which are substantially mirror images of each other, only lower half 107 being shown in FIG. 4. The halves are power press formed from flat strips or sheets of metal, ordinarily low carbon steel or stainless steel. Half 107 is substantially rectangular in plan view and has an outer rim or flange 109 around all four sides which is flat except for curved inlet and outlet collar forming portions 111 and 113 at opposite ends. The flat blank from which the flat flange 109 remains has been press formed to produce four pan-shaped rectangular cups or recesses of rectangular cross section, these being identified by reference numbers 115, 117, 119, and 121. Each has tapered pairs of sidewalls 125 and 127 a flat bottom 129.

The four recesses are separated by three flat divider sections 131, 133, and 135 which extend transversely across the width of the half 107. They are coplanar with the flat outer flange 109. Section 131 separates recesses 115 and 117; section 133 separates recesses 117 and 119; and section 135 separates recesses 119 and 121.

The sections 131, 133, and 135 have semi-cylindrical curved portions formed in them to connect adjacent recesses. Section 131 has three curved portions 137, 139, and 141; section 133 has three curved portions 143, 145, and 147; and section 135 has two curved portions 149 and 151. Curved portions 137, 143, and 149 are aligned on a common axis with each other and with inlet curved portion 111. Curved portions 139 and 145 are aligned on a common axis. Curved portions 141, 147, and 151 are aligned on a common axis with each other and with curved outlet portion 113.

An inlet gas passage member 153 is supported in aligned curved portions 111, 137, and 143. It comprises a tube section 155 in portions 137 and 143 and an inlet bushing section 157 supported in portion 111 and having an inner reduced diameter portion fitting in the upstream end of section 155. A return flow gas passage member comprising a tube 159 is supported in curved portions 139 and 145. An outlet gas passage member 161 is supported in aligned curved portions 141, 147, 151, and 113. It comprises a tube section 163 in portions 141 and 147 and a long outlet bushing section 165 supported in portions 151 and 113 and having an inner reduced diameter portion fitting in the downstream end of tube section 163. A tuning tube 167 is supported in curved portion 149. Tube section. While the tuning tube 167 is imperforate, the tubes 155, 159, and 163 are perforated within recess 117, preferably by way of louver patches 169 in the walls of the tubes. The louver patch 169 in tube 155 opens into an annular closed spit chamber 171 formed around the tube by the pancake or pinch down shell 173.

When the upper half of housing 103 is placed on top of the lower half 107 and welded to it around mating flanges 109, the various tubes will be clamped in place and the mating recesses 115, 117, 119, and 121 will combine to form gas flow and sound attenuation chambers 115, 117, 119, and 121.

It will be recognized that the muffler 101 provides a "tri-flow" path for the flow of gas from the inlet 111 to the outlet 113. Gas entering the muffler flows along inlet passage 153 to the turn-around or cross-over chamber 119 where it expands, reverses flow direction, and enters return tube 159 to flow back toward the inlet end of the muffler. It leaves tube 159 to expand into turn-around or cross-over chamber 115 where it again reverses flow direction to enter the outlet passage 161. The various expansions and contractions of the gas and reversals of direction remove energy from the gases and therefore attenuate sound. Additionally the louver patches 169 in tubes 159 and 163 connect the gas stream to expansion chamber 117 to attenuate medium to high frequency sound. The louver patch 169 in tube section 155 opening into small chamber 171 provides attenuation of high frequencies, roughness type noise, and "spit" in the gases. The dimensions of tube 167 are related to the volume of resonator chamber 129 in accordance with the Helmholtz principle to provide attenuation of a selected low frequency present in the exhaust system.

Figure 5:
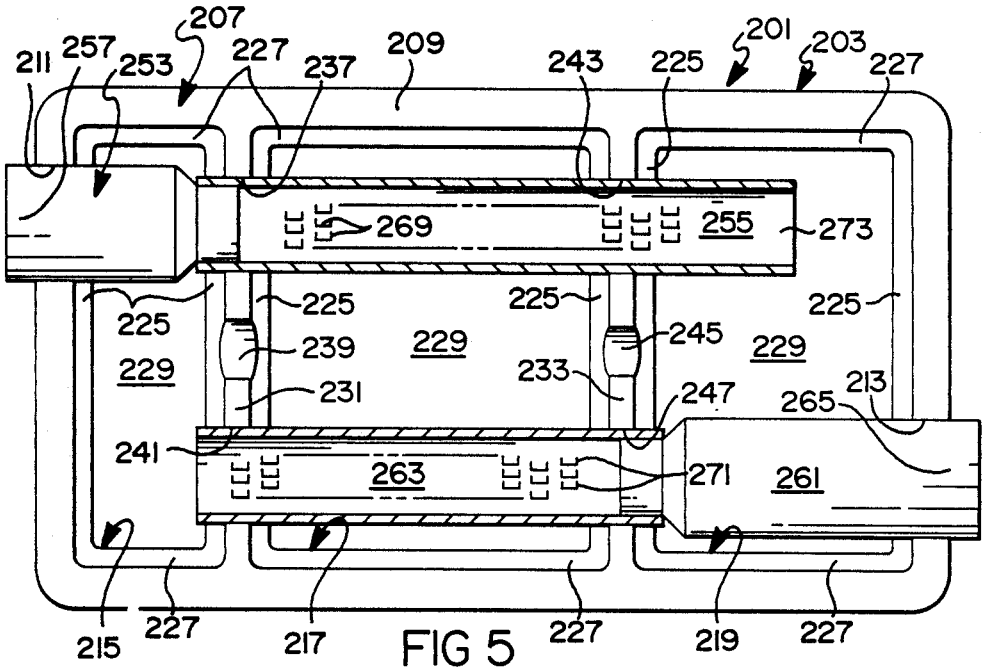
FIG. 5 is a view similar to FIGS. 3 and 4 but showing another muffler construction of the louver flow type.

The muffler 201 of FIG. 5 has an outer housing or shell 203 comprising upper and louver pan-shaped halves (like the halves 5 and 7) which are substantially mirror images of each other, only the lower half 207 being shown in FIG. 5. The halves are stamped from flat strips or sheets of suitable metal such as steel. Half 207 is substantially rectangular in plan view and has an outer flange 209 around all four sides which is flat except for curved inlet and outlet collar portions 211 and 213 at opposite ends. The flat blank from which the flange 209 remains has been press formed to draw three pan-shaped recesses of rectangular cross section, these being identified by reference numbers 215, 217, and 219. Each has tapered pairs of sidewalls 225 and 227 and a flat bottom 229.

The three recesses are separated by two flat divider sections 231 and 233 which extend transversely across the width of the half 207. They are coplanar with the flat outer flange 209. Section 231 separates recesses 215 and 217 and section 233 separates recesses 217 and 219.

The flat sections 231 and 233 have semi-cylindrical curved portions formed in them to connect adjacent recesses. Section 231 has three curved portions 237, 239, and 241; and section 233 has three curved portions 243, 245, and 247. Curved portions 211, 237, and 243 are aligned on a common axis as are curved portions 241, 247, and 213. Curved portions 239 and 245 are preferably in substantial alignment, as shown, but need not be on a common straight axis since they define flow passages rather than tube support surfaces.

A straight inlet gas passage member 253 is supported in aligned curved portions 211, 237, and 243. It comprises a tube section 255 in portions 237 and 243 and an inlet bushing section 257 supported in portion 211 and having an inner reduced diameter portion fitting in the upstream end of section 255. A straight outlet gas passage member 261 is supported in aligned curved portions 241, 247, and 213. It comprises a tube section 263 in portions 241 and 247 and an outlet bushing section 265 supported in portion 213 and having an inner reduced diameter portion fitting in the downstream end of tube section 263. Tubes 255 and 263 each are perforated within recess 217, preferably by means of louver patches 269 and 271, respectively. Tube 255 has an imperforate end portion 273 extending a substantial distance into recess 219.

When the upper half (not shown) of housing 203 is placed on top of half 207 and secured to it, the tubes and bushings will be clamped in place and the mating recesses 215, 217, and 219 will combine to form gas flow and sound attenuation chambers 215, 217, and 219. It will be recognized that the construction shown in FIG. 5 is a form of "louver-flow" muffler. See U.S. Pat. No. 4,111,279 and U.S. Pat. No. 4,192,401. Gas entering the muffler through inlet bushing 257 flows into the louvered section 269 of tube 255 in the relatively large expansion and cross flow chamber 217. Flow through the imperforate portion 273 at the downstream end of tube 255 into chamber 219 is restricted by the relatively small size of tubular outlet opening 245 connecting chambers 219 and 217. The diameter and length of portion 273 in combination with the volume of chamber 219 can therefore be selected to "tune" them to attenuate a desired low frequency, this being broad-banded to some extent by the outlet passage 245. Gas not flowing through passage 245 flows through the louver patch 269 of tube 255 into the mid-chamber 217. Gas in chamber 217 can flow through opening 239 into end chamber 215 and reverse direction to enter the end of outlet passage 261. It can also enter outlet passage 261 by flowing through louver patch 271. The combination of louver patch 269 and gas expansion into chamber 217 from the louver patch 269 and the passage 245 removes acoustic energy and provides attenuation of medium and high sound frequencies. This is enhanced by flow into the outlet passage 261 through louver patch 271 or into expansion and turn around chamber 215 through tubular passage 239.

Figure 6:
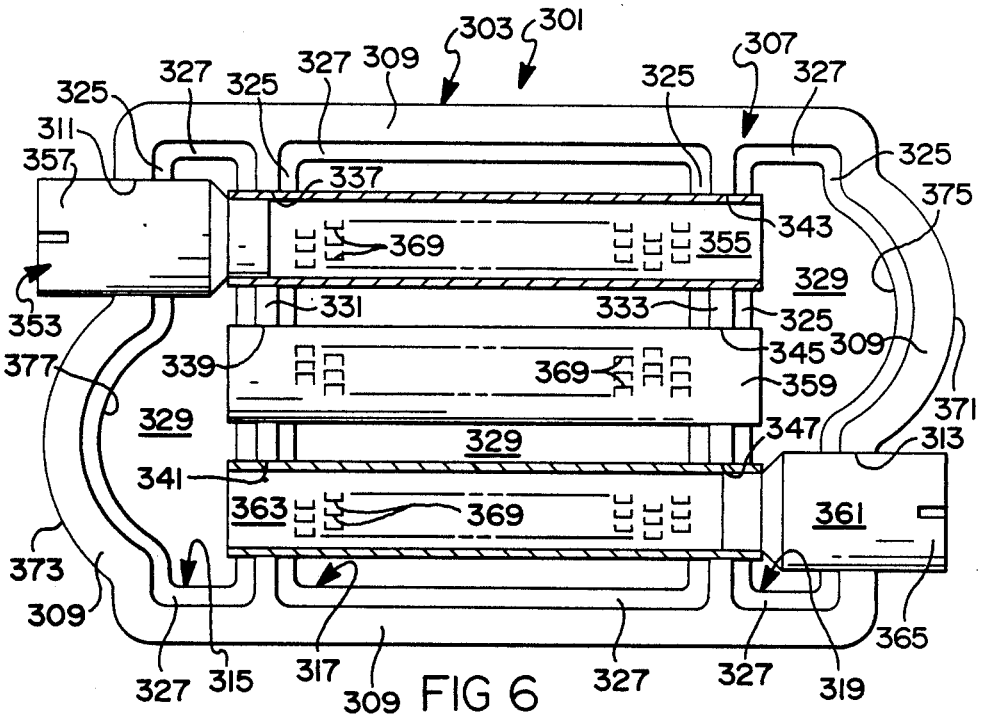
FIG. 6 is a view similar to FIGS. 3, 4, and 5 but showing another muffler construction of the high performance, tri-flow type.

The muffler 301 of FIG. 6 has an outer housing or shell 303 comprising upper and lower pan-shaped halves (like the halves 5 and 7) which are substantially mirror images of each other, only the lower half 307 being shown in FIG. 6. The halves are press-formed from flat strips or sheets of steel or other suitable material. Half 307 has an outer flange 309 all around its opposite longitudinal sides and opposite ends except for curved inlet and outlet forming portions 311 and 313 in the opposite ends. The flat blank from which the flange 309 remains has been drawn in a press to produce three recesses, identified by reference numbers 315, 317, and 319. Each has tapered pairs of sidewalls 325 and 327 and a flat bottom 329.

The three recesses are separated by two flat divider sections 331 and 333 which extend transversely across the width of the half 307. They are coplanar with the flat outer flange 309. Section 331 separates recesses 315 and 317 and section 333 separates recesses 317 and 319.

The flat sections 331 and 333 have semi-cylindrical curved portions formed in them to connect adjacent recesses. Section 331 has three curved portions 337, 339, and 341; and section 333 has three curved portions 343, 345, and 347. Curved portions 311, 337 and 343 are aligned on a common straight axis; curved portions 339 and 345 are aligned on a common straight axis; and curved portions 341, 347, and 313 are aligned on a common straight axis.

A straight inlet gas passage member 353 is supported in aligned curved portions 311, 337, and 343. It comprises a tube section 355 in portions 337 and 343 and an inlet bushing section in portion 311 which has a reduced diameter portion fitting in the upstream end of tube section 355. A straight return flow tube 359 is supported in curved portions 339 and 345. A straight outlet gas passage member 361 is supported in curved portions 341, 347, and 313. It comprises a tube section 363 in portions 341 and 347 and an outlet bushing section 365 in portion 313 and having an inner reduced diameter portion fitting in the downstream end of tube section 363. Tubes 355, 359, and 363 are each perforated within recess 317, preferably by means of louver patches 369.

When the upper half (not shown) of the housing 303 is placed on top of half 307 and secured to it, the tubes and bushings will be clamped in place and the mating recesses will combine to form gas flow and sound attenuation chambers 315, 317, and 319. It will be recognized that the structure shown in FIG. 6 is a form of tri-flow muffler and, in particular, is a low back pressure, high performance tri-flow muffler of the type shown in U.S. Pat. No. 4,735,283, issued on Apr. 5, 1988 to the assignee hereof and in U.S. Pat. No. 4,381,045 issued on Apr. 26, 1983. Gas entering the muffler flows down inlet passage 353 to end chamber 319 where it reverses direction and enters tube 359 to flow back toward the inlet end of the muffler. It enters end chamber 315 and reverses direction to flow into outlet passage 361 and out of the muffler through outlet bushing 365. The abrupt changes in size of the flow path and cross flow into and out of chamber 317 and other acoustic mechanisms remove much energy from the gas to provide significant sound attenuation over a wide range of sound frequencies. Back pressure is minimized by press forming the opposite ends of the shell half 307 to include curvatures 371 and 373 at the outlet and inlet ends, respectively, of the muffler, curvature 371 being aligned with tubes 355 and 359 and curvature 373 being aligned with tubes 359 and 363. The curvatures are preferably shaped to produce (when the upper and lower shell halves are put together) concave inside gas contacting surfaces 375 and 377, respectively, corresponding to those provided by the flow guiding and directing plates 61 and 63, respectively in U.S. Pat. No. 4,735,283. The flange or rim 309 also extends around the curvatures 371 and 373 and tends to reinforce them and help avoid a problem of head ring or drumming associated with gas flow that impinges directly on the end walls of a muffler housing.

Figure 7:
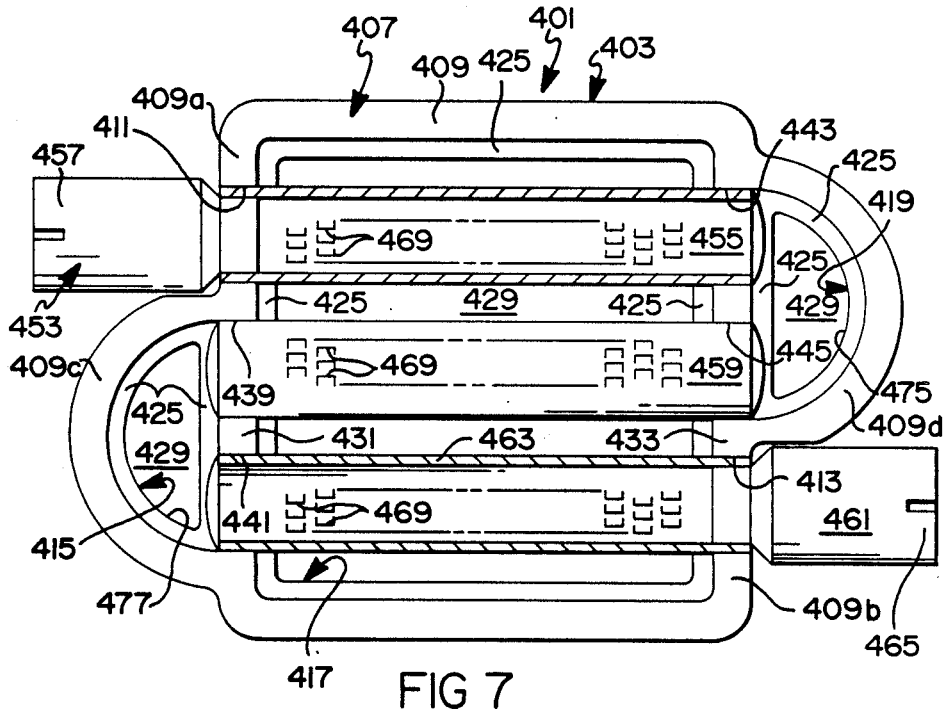
FIG. 7 is a view similar to FIG. 6 but showing another form of high performance tri-flow muffler construction.

Muffler 401 of FIG. 7 is a modification of muffler 301 of FIG. 6. It has an outer housing 403 comprising upper and lower pan-shaped halves which are substantially mirror images of each other, only the lower half 407 being shown in the drawings. Half 407 has an outer flange 409 all around the outside which is flat except for curved inlet and outlet forming portions 411 and 413. The flat metal blank from which the flange 409 remains has been drawn in a press to form the large recess 417 (corresponding to recess 317) and the smaller recesses 415 and 419 (corresponding to recesses 315 and 319) on opposite sides of recess 417. The recesses have tapered sidewalls 425 and flat bottoms 429.

The three recesses are separated by two flat divider sections 431 and 433 which extend transversely across the widths of the smaller recesses 415 and 419. The flat sections 431 and 433 are transversely aligned and coplanar with transverse end portions **409*a* and 409*b* of the outer flange 409. The outer flange 409 also has curved portions 409*c* and 409*d* (corresponding to curvatures 373 and 371 of muffler 301) that extend around the outsides of small recesses 415 and 419**, respectively.

The semi-cylindrical curved inlet and outlet portions 411 and 413 are in transverse end portions **409*a* and 409*b*, respectively, of the flat flange 409. Flat divider sections 431 and 433 also have semi-cylindrical curved portions formed in them to connect adjacent chambers. Section 431 has curved portions 439 and 441; and flat section 433 has curved portions 443 and 445. Curved portions 411 and 443 are aligned on a common axis; curved portions 439 and 445 are aligned on a common axis; and curved portions 441 and 413** are aligned on a common axis.

A straight inlet gas passage member 453 is supported in aligned portions 411 and 443. It comprises a straight tube section 455 in portions 411 and 443 and an inlet bushing section 457 having a reduced inner end fitting in and supported by the upstream end of tube 455. A straight return flow tube 459 is supported in portions 439 and 445. A straight outlet gas passage member 461 is supported in curved portions 441 and 413. It comprises a tube section 463 in curved portions 441 and 443 and an outlet bushing section 465 having an inner reduced diameter section fitting in and supported by the downstream end of the tube section 463. Tubes 455, 459, and 463 are each perforated within recess 417, preferably by means of louver patches 469.

When the upper half (not shown) of housing 403 is placed on top of half 407 and secured to it, the tubes will be clamped in place and the mating recesses will combine to form gas flow and sound attenuation chambers 415, 417, and 419. As indicated above, muffler 401 is a modification of muffler 301 and small chambers 415 and 419 are shaped to provide flow directing and guiding surfaces 475 and 477 corresponding to those provided by the plates 63 and 61, respectively, of U.S. Pat. No. 4,735,283, and surfaces 375 and 377 of muffler 301 described above. Again, the rim 409 and rim portions **409*c* and 409*d* will reinforce the curved gas impingement surfaces 475 and 477** against head ring and drumming.

Modifications may be made in the specific structures shown without departing from the spirit and scope of the invention.

What is claimed is:

1. A sound attenuating exhaust gas muffler for automotive type exhaust gas systems comprising a housing having an inlet collar and an outlet collar, said housing including an upper sheet metal blank having a rim extending all around the blank and having a pair of recesses drawn in the blank inside of said rim, said upper blank having a divider section extending from one side of the rim to the other and located between and at adjacent edges of the recesses, said rim and said divider section of said upper blank being coplanar and substantially flat, said housing including a lower sheet metal blank having a rim extending all around the blank and having a pair of recesses drawn in the blank inside of said rim, said lower blank having a divider section extending from one side of the rim to the other and located between and at adjacent edges of the recesses, said rim and said divider section of said lower blank being coplanar and substantially flat, the rims of the upper and lower sections and the divider sections of said upper and lower sections fitting against each other to form said housing, the recesses of the upper blank extending upwardly away from the plane of the fitted together rims and the recesses of the lower blank extending downwardly away from the plane of the fitted together rims, the recesses of the upper blank being aligned with the recesses of the lower blank and each pair of aligned upper and lower blank recesses combining to form an internal chamber whereby said housing has a pair of internal chambers separated by said fitted together divider sections, said divider sections each having a curved portion therein providing communication between the adjacent recesses, the curved portions of the divider sections in the upper and lower blanks being aligned and combining to form a tubular passage, a gas flow tube fitting in said tubular passage and providing for gas flow between the internal chambers, said inlet and outlet collars being in gas flow communication with said internal chambers.

2. A sound attenuating exhaust gas muffler for automotive type exhaust gas systems comprising a housing having an inlet collar and an outlet collar, said housing including an upper sheet metal blank having a rim extending all around the blank and having a plurality of recesses drawn in the blank inside of said rim, said upper blank having a divider section between each pair of adjacent recesses extending from one part of the rim to another part of the rim and located between and at adjacent edges of the recesses, said rim and said divider sections of said upper blank being coplanar and substantially flat, said housing including a lower sheet metal blank having a rim extending all around the blank and having a plurality of recesses drawn in the blank inside of said rim, said lower blank having the same number of recesses as the upper blank, said lower blank having a divider section between each pair of adjacent recesses extending from one part of the rim to another part of the rim and located between and at adjacent edges of the recesses, said rim and said divider sections of said lower blank being coplanar and substantially flat, the rims of the upper and lower sections and the divider sections of said upper and lower sections fitting against each other to form said housing, the recesses of the upper blank extending upwardly away from the plane of the fitted together rims and the recesses of the lower blank extending downwardly away from the plane of the fitted together rims, the recesses of the upper blank being aligned with the recesses of the lower blank and each pair of aligned upper and lower blank recesses combining to form an internal chamber whereby said housing has a plurality of internal chambers separated by said fitted together divider sections, said divider sections each having curved portions therein providing communication between the adjacent recesses, the curved portions of the upper and lower divider sections being aligned and combining to form tubular passages, gas flow tube members fitting in said tubular passages providing for gas flow between the internal chambers, said inlet and outlet collars being in gas flow communication with said internal chambers.

3. A muffler as set forth in claim 2 wherein said gas flow tubes are fitted in less than all of said tubular passages.

4. A muffler as set forth in claim 2 wherein at least one of said inlet and outlet collars comprises curved portions in the rims of the upper and lower blanks, said curved portions being aligned with at least one tubular passage in the divider sections.

5. A muffler as set forth in claim 4 wherein both of said inlet and outlet collars comprise curved portions in the rims of the upper and lower blanks, said collars being aligned with tubular passages in the divider sections, and gas flow tube members fitting in both the collars and said last mentioned tubular passages.

6. A muffler as set forth in claim 2 wherein at least one of said gas flow tube members has transversely extending projections engageable with the divider sections to longitudinally position the tube member in the housing.

7. A muffler as set forth in claim 2 wherein at least one of said gas flow tube members is perforated, said muffler including a tubular housing member securely mounted on said perforated tube member and providing a closed chamber around the perforations to form a high frequency sound attenuation means, said housing member being engageable with said divider sections to longitudinally position the tube member in the housing.

8. A muffler as set forth in claim 2 wherein the curved portions of said divider sections combine to form first and second tubular passages extending substantially parallel to each other and to the length of the housing, said first and second tubular passages opening into aligned upper and lower blank recesses at one end of the housing, portions of the end walls of the upper and lower blanks and portions of the rims of the upper and lower blanks at said one end being curved to provide said upper and lower blank recesses with concave curved walls spaced from and aligned with the open ends of the first and second tubular passages whereby said curved walls are adapted to guide and direct gas flow from the first tubular passage to the second tubular passage.

9. A muffler as set forth in claim 2 wherein said housing has first, second, and third internal chambers, first divider sections between the first and third internal chambers and second divider sections between the second and third internal chambers, said first divider sections having combined curved portions aligned respectively with said inlet and outlet collars and said second divider sections having combined curved portions aligned respectively with said inlet and outlet collars, a first of said gas flow tube members fitting in said inlet collar and in the curved portions aligned with said inlet collar and opening into the second chamber, a second of said gas flow tube members fitting in said outlet collar and in the curved portions aligned with said outlet collar and opening into said first chamber, said first and second divider sections having additional curved portions connecting the first, second, and third chambers.

10. A muffler as set forth in claim 9 wherein there are only said first and second gas flow tube members and each has a perforated portion located in the third internal chamber to provide for gas flow from the first gas flow tube member out of its perforated portion into the third internal chamber and from the third chamber through the perforated portion of the second gas flow tube member into the second gas flow tube member.

11. A muffler as set forth in claim 9 including a third gas flow tube member fitting in said additional curved portions of the first and second divider sections and having one end opening into the first internal chamber and the other end opening into the second internal chamber.

12. A muffler as set forth in claim 11 wherein each of said gas flow tube members has a perforated portion located in said third chamber.

13. A muffler as set forth in claim 12 including a housing in the third chamber mounted on and surrounding the perforated portion of one of said gas flow tube members to provide a small volume chamber for attenuation of high sound frequencies.

14. A muffler as set forth in claim 11 wherein portions of each of the end walls of the upper and lower blanks and portions of the rims of the upper and lower blanks are curved to provide said upper and lower blank recesses with concave curved walls located in the first and second internal chambers and spaced from and aligned with the ends of the gas flow tube members whereby said curved walls are adapted to guide and direct gas flow from the first gas flow tube member to the third gas flow tube member and from the third gas flow tube member to the second gas flow tube member.

15. A muffler as set forth in claim 11 wherein said housing has a fourth internal chamber at one end of the housing located longitudinally outwardly of the other internal chambers, third divider sections in the upper and lower blanks between the fourth internal chamber and the longitudinally adjacent chamber, said third divider sections having curved portions which combine to provide a tubular passage connecting the fourth internal chamber and said longitudinally adjacent chamber.

16. A muffler as set forth in claim 15 wherein said housing has a fifth internal chamber at the other end of the housing from the fourth internal chamber, fourth divider sections in the upper and lower blanks between the fifth internal chamber and the longitudinally adjacent chamber, said fourth divider sections having curved portions which combine to provide a tubular passage connecting the fifth internal chamber and said longitudinally adjacent chamber.

17. A muffler as set forth in claim 14 wherein said first and second divider sections and said first and second internal chambers extend across the full width of the housing.

18. A muffler as set forth in claim 14 wherein said first and second divider sections and said first and second internal chambers extend across less than the full width of the housing but substantially across the spacing of two adjacent gas flow tubes.

19. A sound attenuating exhaust gas muffler for automotive type exhaust gas systems comprising a housing having an inlet collar and an outlet collar, said housing including an upper sheet metal blank having a rim extending all around the blank and having a plurality of recesses drawn in the blank inside of said rim, said upper blank having a divider section between each pair of adjacent recesses extending from one part of the rim to another part of the rim and located between and at adjacent edges of the recesses, said rim and said divider sections of said upper blank being coplanar and substantially flat, said housing including a lower sheet metal blank having a rim extending all around the blank and having a plurality of recesses drawn in the blank inside of said rim, said lower blank having a divider section between each pair of adjacent recesses extending from one part of the rim to another part of the rim and located between and at adjacent edges of the recesses, said rim and said divider sections of said lower blank being coplanar and substantially flat, the rims of the upper and lower sections and the divider sections of said upper and lower sections fitting against each other to form said housing, the recesses of the upper blank extending upwardly away from the plane of the fitted together rims and the recesses of the lower blank extending downwardly away from the plane of the fitted together rims, the recesses of the upper blank being aligned with the recesses of the lower blank and each pair of aligned upper and lower blank recesses combining to form an internal chamber whereby said housing has a plurality of internal chambers separated by said fitted together divider sections, said divider sections each having a curved portion therein providing communication between the adjacent recesses, the curved portions of the upper and lower divider sections being aligned and combining to form tubular passages, gas flow passage means fitting in said tubular passages providing for gas flow between the internal chambers, said inlet and outlet collars being in gas flow communication with said internal chambers, said divider sections having curved portions combining to form first and second tubular passages extending substantially parallel to each other and to the length of the housing, said first and second tubular passages opening into aligned upper and lower blank recesses at one end of the housing, portions of the end walls of the upper and lower blanks and portions of the rims of the upper and lower blanks at said one end being curved to provide said upper and lower blank recesses with concave curved walls spaced from and aligned with the open ends of the first and second tubular passages whereby said curved walls are adapted to guide and direct gas flow from the first tubular passage to the second tubular passage.

20. A muffler as set forth in claim 19 wherein said divider sections have curved portions combining to form a third tubular passage extending substantially parallel to the first and second tubular passages, said second and third tubular passages opening into aligned upper and lower blank recesses at the other end of the housing, portions of the end walls of the upper and lower blanks and portions of the rim of said upper and lower blanks at said other end being curved to provide said upper and lower blank recesses with concave curved walls spaced from and aligned with the open ends of the second and third tubular passages whereby said curved walls are adapted to guide and direct gas flow from the second tubular passage to the third tubular passage.

* * * * *